United States Patent [19]

Koskivirta

[11] 4,227,846

[45] Oct. 14, 1980

[54] METHOD AND APPARATUS FOR LOADING OR UNLOADING WATER VESSELS

[75] Inventor: Veikko Koskivirta, Vantaa, Finland

[73] Assignee: Valmet Oy, Finbaal, Finland

[21] Appl. No.: 913,483

[22] Filed: Jun. 7, 1978

[51] Int. Cl.[3] ..... B65G 67/58

[52] U.S. Cl. ..... 414/139; 114/258; 212/190; 414/786

[58] Field of Search ..... 214/12, 13, 14, 15 R, 214/15 C, 38 CA, 152; 212/3; 114/258, 259, 260, 263; 414/137, 138, 139, 140, 143, 786

[56] References Cited

U.S. PATENT DOCUMENTS

| | | | |
|---|---|---|---|
| 10,843 | 5/1854 | Young | 214/12 |
| 304,040 | 8/1884 | Snee | 212/3 |
| 738,084 | 9/1903 | Titcomb | 212/3 X |
| 3,414,143 | 12/1968 | Scott | 214/14 |
| 3,543,952 | 12/1970 | Young | 214/14 |
| 3,645,405 | 2/1972 | Stiglich | 212/3 |
| 3,704,796 | 12/1972 | Dedons et al. | 214/14 |
| 3,938,676 | 2/1976 | Croese | 214/14 X |
| 4,055,264 | 10/1977 | Abbott | 214/14 X |

OTHER PUBLICATIONS

Conveyorized Piers to Speed Container Flow, Mechanical Handling, Oct. 1969, p. 92.

*Primary Examiner*—L. J. Paperner
*Attorney, Agent, or Firm*—Steinberg and Blake

[57] ABSTRACT

A method and apparatus for loading and/or unloading water vessels including providing a pair of floating elongate pontoon members and locating the same substantially parallel to and spaced from each other substantially perpendicular to the edge of a dock or quay so as to define an area between the pontoon members for accommodating a water vessel. The vessel which is to be loaded or unloaded is directed between the pontoon members. Mobile crane apparatus is supported on the pontoon members on either side of the vessel and travels along the length of the pontoon members, and has hoisting apparatus which horizontally extends over the width of the vessel. In another embodiment, an elongate pontoon member is located substantially parallel to the edge of the dock or quay defining a vessel accommodating area between them. Mobile crane apparatus is movably supported on the pontoon member and quay on either side of the vessel and has a hoisting apparatus horizontally extending over the width of the vessel.

4 Claims, 5 Drawing Figures

METHOD AND APPARATUS FOR LOADING OR UNLOADING WATER VESSELS

BACKGROUND OF THE INVENTION

This invention relates generally to cargo handling and, more particularly, to a method and apparatus for loading cargo onto or unloading cargo from a water vessel from or to a dock or quay.

Handling of cargo on water vessels is and has been accomplished by one of two usual methods, namely, a lift-on lift-off (Lo-Lo) system or a roll-on roll-off (Ro-Ro) system. As their names imply, the former system requires the use of derricks or cranes located on the vessel and/or the quay while the latter system employs ramps extending between the quay and the vessel on which cargo is rolled onto or off of the vessel.

Neither of these systems has proven to be entirely satisfactory however. Firstly, both systems require large investments in the form of quays and equipment. In the case of the lift-on lift-off system, the harbor cranes in conventional use, although movable to various locations on the quay, are limited with respect to the extent of their horizontal reach. This presents a problem where cargo must be stowed on a vessel at a location beyond the reach of the crane or, conversely, where cargo to be unloaded is located beyond the reach of the crane or not directly below it. The problem becomes particularly acute in the case of loading and unloading barges in shallow inland waterways where the vessel cannot be brought directly alongside the dock. In such cases, the crane operator is not always able to maintain visual contact with the cargo being carried by the crane and it is not unusual for such inconveniently positioned cargo to begin to sway upon being lifted by the crane. Such swaying involves a substantial risk of injury to personnel, cargo and equipment. In the case of the roll-on roll-off system, not only is it common for the water level in harbors to change during loading and/or unloading, but it is also evident that the draft of the vessel will change during loading or unloading of cargo. These conditions result in changes in the angular attitude of the ramps which extend between the vessel and quay on which the cargo is rolled and, frequently, the angle of the ramps become so steep as to prevent their use altogether.

SUMMARY OF THE INVENTION

Accordingly, one object of the present invention is to provide a new and improved apparatus and method for loading or unloading cargo onto or from water vessels.

Another object of the invention is to provide a new and improved cargo loading apparatus and method for water vessels having maximum access to all locations on the vessel, i.e., its horizontal reach is substantially unlimited.

Still another object of the invention is to provide a new and improved cargo loading apparatus and method for water vessels which is suitable for the loading and unloading of barges, especially in inland waters.

Yet another object of the present invention is to provide new and improved cargo loading apparatus for water vessels where the crane operator can maintain visual contact at all times with the cargo.

Yet still another object of the present invention is to provide such a method and apparatus where the crane may always be positioned vertically over the cargo to be loaded or unloaded so as to avoid deleterious swaying of the cargo upon hoisting.

A further object of the invention is to provide a new and improved cargo loading apparatus and method for water vessels which is selectively adjustable to compensate for changes in the draft of the vessel and/or water level.

A still further object of the invention is to provide a new and improved cargo loading apparatus and method for water vessels which is economical and safe in use.

Briefly, in accordance with a preferred embodiment of the invention, these and other objects are attained by providing a pair of floating elongate pontoon members substantially parallel to and spaced from each other, each pontoon member preferably extending substantially perpendicularly to the edge of the dock or quay, so as to define an area between the pontoon members for accommodating the vessel. A mobile crane apparatus is provided which includes a pair of carriage assemblies, each of the carriage assemblies being supported for movement along the length of a respective one of the pontoon members. A beam member, including cargo hoisting apparatus, has its end portions affixed to respective ones of the carriage assemblies, so that the beam member extends over the vessel accommodating area. The pair of pontoon members may be integrally formed with a buoyant loading platform located contiguous to the dock. In another embodiment, an elongate pontoon member is located substantially parallel to the edge of the dock or quay so that the pontoon member and the quay edge define an area for accommodating the water vessel. A similar mobile crane apparatus is provided wherein the two carriage assemblies are supported for movement along the length of the pontoon member and the surface of the dock or quay, respectively, so that the crane beam member similarly extends over the vessel accommodating area. The vessel which is to be loaded or unloaded is directed into the vessel accommodating area and the crane apparatus is driven along the pontoon members or pontoon member and quay, so that the cargo hoisting apparatus horizontally extends across the width of the vessel, until it is located directly above the cargo to be hoisted. Thus, the raising or lowering of the cargo from or onto the vessel by the crane is performed at the place where the cargo is located.

DESCRIPTION OF THE DRAWINGS

A more complete appreciation of the invention and many of the attendant advantages thereof will be readily appreciated as the same becomes better understood by reference to the following detailed description when considered in connection with the accompanying drawings, in which.

DESCRIPTION OF PREFERRED EMBODIMENTS

Figure 1:
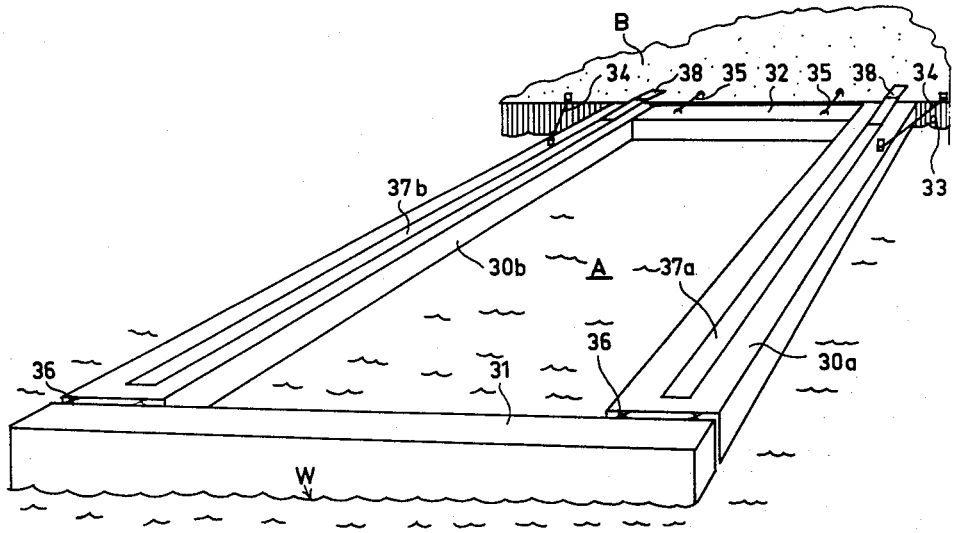
FIG. 1 is a perspective view illustrating the location of pontoon members adjacent the quay according to one embodiment of the invention.

Referring now to the drawings wherein like reference characters designate identical or corresponding parts throughout the several views, and more particularly to FIG. 1 thereof, a pair of floating elongate pontoons 30*a* and 30*b*, are each affixed at one end to the quayside 33 by cables 34 or the like. The pontoons, which are preferably rectangular in cross section, are at least as long as a conventional barge or similar water vessel and may be as long as two or more vessels to accommodate loading or unloading of a plurality of vessels as described below. Pontoons 30*a*, 30*b* are otherwise conventional in construction being sufficiently buoyant to support the weight of the mobile crane described below and the cargo hoisted thereby.

The quay has an area, designated B, for placing the cargo that is to be loaded or unloaded as well as for the travel of the mobile crane apparatus as will become evident.

Pontoons 30*a*, 30*b* extend substantially parallel to each other and preferably substantially perpendicularly from quayside 33. A space, designated A, is defined between the pontoons 30*a*, 30*b* of a size sufficient to accommodate at least one water vessel 10 (FIG. 2) that is to be loaded or unloaded.

Figure 2:
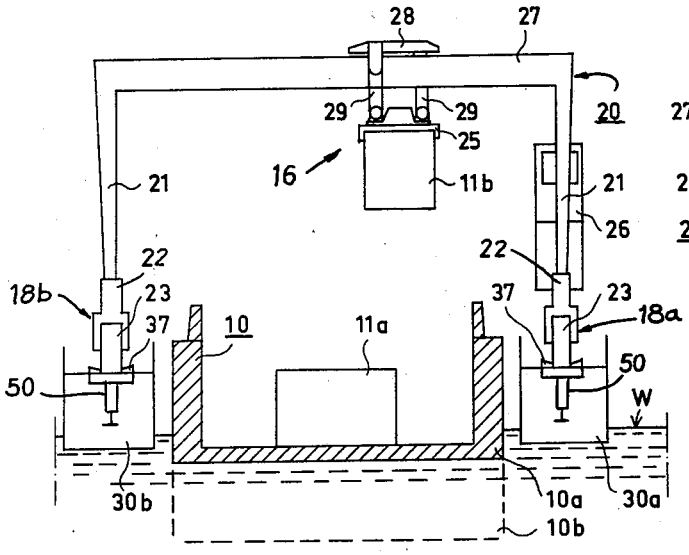
FIG. 2 is a front elevation view of the embodiment of the present invention shown in FIG. 1, illustrating a water vessel being loaded.

The pontoons 30*a*,30*b* are each provided on their upper surfaces 50*a*,50*b*, respectively, with tracks or channels 37*a*,37*b* for the support of the wheels of a mobile crane apparatus. Tracks 37*a*,37*b* may comprise a high friction surface, such as a rubber compound, and may include raised side sections as seen in FIG. 2 to facilitate the guidance of the crane apparatus. Ramps 38 extend over the small space separating the quayside 33 and the ends of the pontoons proximate thereto to permit the crane to travel between the pontoons and the quay area B. The outer ends of the pontoons 30*a*,30*b* are preferably interconnected by an elongate, buoyant gating member 31 whose ends are connected to the pontoon outer ends by releasable locking elements 36, thereby normally closing the space A defined between pontoons 30*a*,30*b*. A buoyant spacing member 32 is moored to the quayside by cables 35 between the inner ends of pontoons 30*a*,30*b*.

Figure 3:
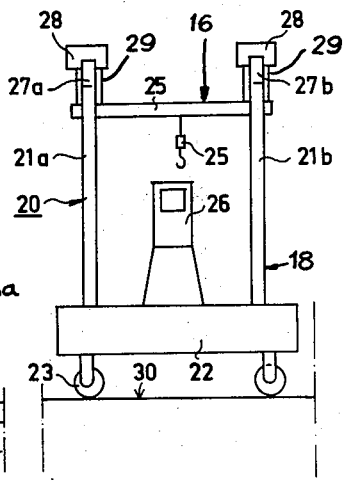
FIG. 3 is a side view of the carriage assembly of the mobile crane apparatus of the present invention.

Referring to FIGS. 2 and 3, the mobile crane apparatus, generally denoted as 20, is shown in association with the pontoons 30*a*,30*b*. Crane apparatus 20 includes a pair of carriage assemblies 18*a* and 18*b*, supported for movement on pontoons 30*a*,30*b*, respectively, a pair of beams 27*a* and 27*b* (FIG. 3) extending horizontally between carriage assemblies 18*a*,18*b* and hoisting apparatus 16 mounted for movement on beams 27*a*,27*b*. More particularly, each carriage assembly 18 includes a pair of wheels 23, preferably rubber, mounted on and supporting a lower frame 22 in which the engine and other equipment is housed. A pair of columns 21*a* and 21*b* extend upwardly from frame 22. The beams 27*a* and 27*b* extend horizontally between and have their end portions affixed to the respective pairs of columns 21*a*,21*b* thereby interconnecting the carriage assemblies 18*a* and 18*b*. Hoisting apparatus 16 includes carriages 28 which are adapted to traverse the length of beams 27*a*,27*b* under the control of the crane operator as is conventional. Cargo grasping elements 25, such as the type suitable for use in lifting frame containers, are supported by carriages 28 through lifting cables 29. Thus, the transverse positioning of the grasping elements 25 is set by the controlled movement of carriages 28 on beams 27 and the lifting and lowering of the cargo is accomplished through controlled actuation of lifting cables 29. A cabin 26 for the crane operator is supported on the frame 22 of carriage assembly 18*a*. Cabin 26 is provided in a relatively high position so as to provide good visibility when the crane 20 is being moved when the cargo is being handled.

Although the crane apparatus 20 described hereinabove is of conventional construction, it is preferable that hydraulic controls be provided so that all of the wheels 23 are mutually independently powered.

In operation, the gating member 31 is disconnected from at least one of the pontoons and is moved so that a vessel 10 (FIG. 2) may be directed into the space A defined between pontoons 30*a*,30*b* whereupon the gating member 31 is reconnected so as to enclose the vessel in space A without having to moor it. Where a cargo is to be loaded onto the vessel from the quay, the cargo grasping elements 25 of mobile crane 20, which is located on quay surface B, grasps the cargo and hoists the same via hoisting apparatus 16. The crane 20 is then directed by the operator such that the carriage assemblies 18*a*,18*b* run over ramps 38 onto the tracks 37*a*,37*b* of pontoons 30*a*,30*b*, respectively. The operator directs the crane along tracks 37 and moves the carriage 28 to a position wherein the hoisting apparatus and the cargo held thereby is located directly over the area where the cargo is to be unloaded whereupon the operator lowers the cargo. Of course, the unloading of cargo from the vessel comprises the same steps recited above, but reversed. The cargo is preferably hoisted to a point just below the beams 27 during movement of crane 20 in order to avoid undue swaying.

Referring to FIG. 2, the outline of vessel 10 at full draft is shown by phantom line 10*b*. It is clear that the extent of the draft of the vessel does not affect the loading and unloading operation.

Figure 4:
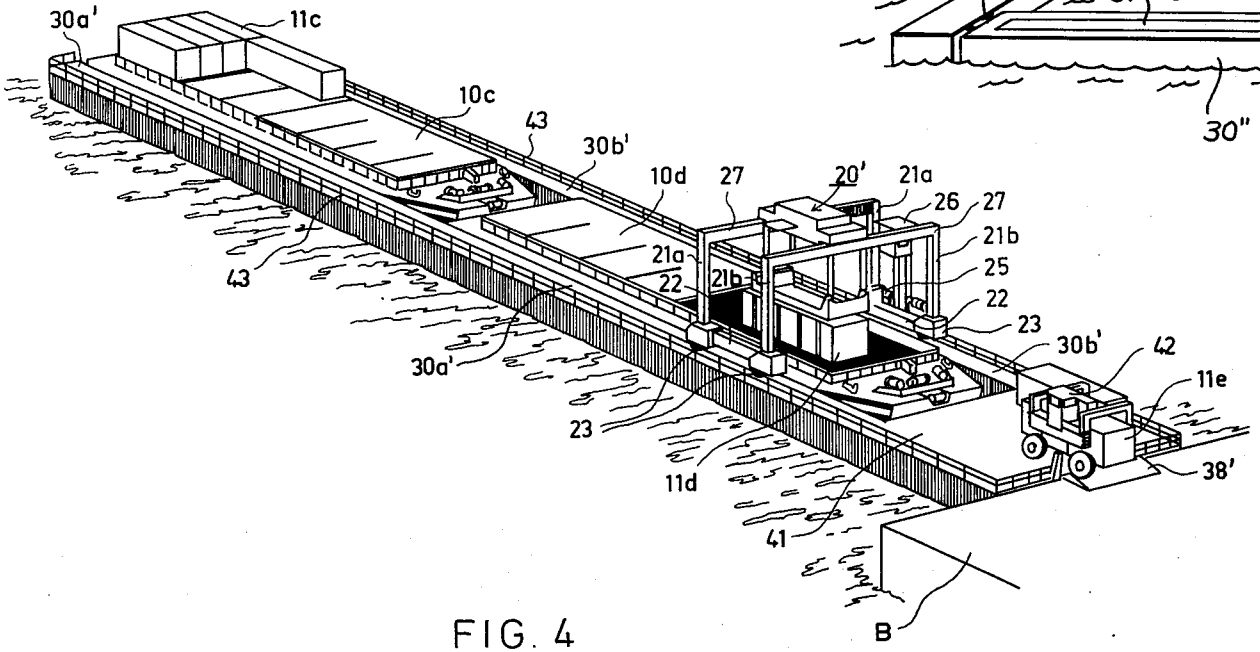
FIG. 4 is a perspective view of another embodiment of the present invention.

Referring now to FIG. 4, another embodiment of the present invention is illustrated and elements thereof corresponding to elements of the embodiment shown in FIGS. 1 through 3 are indicated by the same numerals, primed. In this embodiment, a buoyant platform member 41 is integrally formed with and interconnects the quayside ends of pontoons 30*a*′,30*b*′. In this embodiment, the mobile crane 20′ does not travel onto the quay area B but travels along the length of pontoons 30*a*′,30*b*′ and platform member 41. In the use of this embodiment of the invention, a ramp 38′ is provided extending between platform member 41 and quay area B so that other cargo handling equipment, such for example as lorries or lift trucks 42, can transfer cargo between platform member 41 and the quay. The embodiment of the invention shown in FIG. 4 is particularly suitable for use where the shallowness of the water prevents the pontoons from being located immediately adjacent the quayside.

The above described embodiment of the invention is particularly well suited for the loading and unloading of open barges, such as barges having dimensions of approximately 11.5 by 76.5 meters. The mobile cranes have capacities of about 20 to 40 tons of load.

In accordance with FIG. 4 the pontoons 30*a*′ and 30*b*′ are of such a length that there is room between them for two vessels end to end. As shown in FIG. 4, two open barges 10*c* and 10*d* are located between the pontoons 30*a*′, 30*b*′, barge 10*c* having been loaded so that there are cargo containers 11*c* on its top deck. FIG. 4 illustrates the loading of barge 10*d*, i.e., with containers 11*d* being located into the hold of barge 10*d*.A straddle carrier is bringing cargo 11*e* from the quay onto platform member 41 from where mobile crane 20' carries it onto vessel 10*d*. In the embodiment of the invention shown in FIG. 4, several straddle carriers 42 may be used, or other such equipment, especially when the distances of cargo transfer in the quayside area B are relatively long ones. The moving of the cargo into or from a vessel located between the pontoons 30*a'*, 30*b'* can be performed either with a mobile crane 20' taking or leaving the cargo 11 directly from or on the truck 42 positioned as shown in FIG. 4, or by first putting the cargo down on platform 41 which, if necessary can be made far longer than indicated in FIG. 4, in order to provide adequate space for cargo handling. FIG. 4 shows the width of area 41 to be the same as the distance between the outer edges of pontoons 30*a'*, 30*b'* but when necessary area 41 can be made broader to meet the requirement of cargo handling and type of cargo. FIG. 4 further shows the pontoon equipment to be fitted with railings 43 which ensure that the mobile crane 20' remains on the pontoons.

In accordance with the invention the pontoons can be equipped with a mechanism such, for example, as hydraulic cylinders 50 (FIG. 2) for the adjustment of the elevation of the track 37 or with ballast so that the tracks 37 can be adjusted to the elevation of the top of the quayside 33 regardless of the variations in the water level W (FIG. 2).

Figure 5:
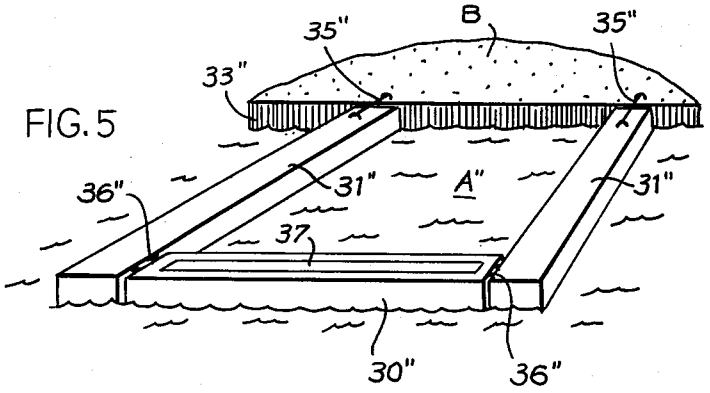
FIG. 5 is a perspective view illustrating the location of pontoon members, according to a third embodiment of the present invention.

Referring to FIG. 5, another embodiment of the invention is illustrated, elements corresponding to elements shown in the embodiment of FIGS. 1 through 3 being designated by the same numerals, double primed. Thus, the invention can be implemented by employing a single pontoon 30'' that floats on the water, and which is located via buoyant gating members 31'' in a manner substantially parallel to the quayside 33'' such that a space A'' is defined between the pontoon and the quayside, the width of the space A'' preferably approximating the width of the vessel and the mobile crane 20. In the operation of this embodiment, the loading and/or unloading of the vessel is performed in the same manner as described in connection with FIGS. 2 and 3. Of course, in this case, the carriage assembly on the one side of the mobile crane 20'' runs on the quayside while the other carriage assembly runs on track 37'' of pontoons 30''.

It is evident from the above that the present invention provides many advantages over conventional cargo loading and unloading apparatus. Thus, the mobile crane performs the hoisting and lowering of the cargo at the precise desired location with the crane operator closely monitoring the position of the load. The swaying of the load so common in the case of conventional lift-on lift-off methods is eliminated. There is no intermediate cargo handling required and the use of the present invention requires only a single operator. The tracks on the pontoons can be kept level with the quay and changes in the draft of the vessel or the level of the water do not effect the efficiency of the invention. The vessel need not be moored, but will remain in position between the pontoons. The apparatus of the invention is easily transported on water and can quickly be set up for operation. As mentioned above, the invention is particularly advantageous in the loading and unloading of open barges. Since such barges are particularly suited for travel on inland waterways, such as rivers, canals, lakes and shallow sheltered sea coasts, use of the invention will extend efficient and economical sea transport to localities that would otherwise depend on land transport for contact with the sea ports.

Obviously, numerous modifications and variations of the present invention are possible in the light of the above teachings. For example, although the mobile crane was described above as being supported on rubber wheels, in the case of the use of the invention in large ports, the crane may be fitted so as to move on rails, which may be extended onto the pontoons. Additionally, it is possible to accommodate more than one vessel widthwise, i.e., side by side, between the pontoons, with the beam 27 of the mobile crane extending over both vessels simultaneously. It is therefore to be understood that within the scope of the appended claims the invention may be practiced otherwise than is specifically described herein.

What is claimed is:

1. Apparatus for transporting cargo between a water vessel and a quay comprising:

a pair of elongate substantially parallel pontoon members extending substantially perpendicularly to the edge of said quay, said pontoon members being spaced from each other so as to define an area between them for accommodating at least one water vessel and wherein each pontoon member has a first end proximate to the quay edge and a second distal end and track means extending over the substantial length thereof between said first and second ends;

mobile crane apparatus including a pair of carriage assemblies, each of said carriage assemblies being supported for movement on said track means of a respective one of said pontoon members, a beam member having end portions affixed to respective ones of said carriage assemblies, said beam member extending substantially horizontally over the vessel accommodating area, and means associated with said beam member for engaging and supporting the cargo;

ramp means extending between and interconnecting the first end of each of said pontoon members and the quay; and means for adjusting the height of said track means relative to the quay for substantially aligning said track means with the surface of said quay;

whereby said crane apparatus can be moved between said pontoon members and quay over said ramp means.

2. Cargo transport apparatus as recited in claim 1 further including means extending between the distal ends of said pontoon members for selectively opening and closing the vessel accommodating area defined by said pontoon members.

3. Cargo transport apparatus as recited in claim 1 further including means extending between the distal ends of said pontoon members for selectively opening and closing the vessel accommodating area defined by said pontoon members.

4. A method for transporting cargo between a water vessel and a quay comprising the steps of:

locating a pair of elongate pontoon members substantially parallel to and spaced from each other, so that each pontoon member is substantially perpendicular to the edge of the quay, each pontoon member having a first end proximate to the quay edge and a second distal end and track means extending over the substantial length thereof between said first and second ends, an area being defined between the pontoon members for accommodating said water vessel;

providing mobile crane apparatus including a pair of carriage assemblies, each of said carriage assemblies being movably engaged on said track means of a respective one of said pontoon members, a beam member having end portions affixed to respective ones of said carriage assemblies, said beam member extending substantially horizontally over the vessel accommodating area, and means associated with said beam member for engaging and supporting the cargo;

providing ramp means which extend between and interconnect the first end of each of said pontoon members and the quay;

providing means for adjusting the height of said track means relative to the quay;

adjusting the height of said track means relative to the quay so as to substantially align said track means with the surface of said quay;

directing the water vessel into the accommodating area defined between said pontoon members;

locating the mobile crane apparatus by moving said carriage members on said pontoon members to a position wherein said cargo engaging means substantially vertically overlies the cargo to be transported;

causing said cargo engaging means to engage said cargo;

transporting said cargo by relocating the mobile crane apparatus by moving said carriage members on said track means of said pontoon members over said ramp means to a position wherein said cargo engaging means substantially vertically overlies the area to which the cargo is to be transported; and causing said cargo engaging means to disengage said cargo.

* * * * *